US008104869B2

(12) United States Patent
Muhl et al.

(10) Patent No.: US 8,104,869 B2
(45) Date of Patent: Jan. 31, 2012

(54) DEVICE FOR KEEPING AN INKJET PRINT HEAD CLEAN

(75) Inventors: Wolfgang Muhl, Hohen Neuendorf (DE); Axel Ortmann, Berlin (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 722 days.

(21) Appl. No.: 12/264,289

(22) Filed: Nov. 4, 2008

(65) Prior Publication Data

US 2009/0141076 A1 Jun. 4, 2009

(30) Foreign Application Priority Data

Nov. 30, 2007 (DE) ..... 10 2007 057 819

(51) Int. Cl.
*B41J 2/165* (2006.01)

(52) U.S. Cl. ..... 347/33

(58) Field of Classification Search ..... 347/33
See application file for complete search history.

(56) References Cited

U.S. PATENT DOCUMENTS

| | | | | |
|---|---|---|---|---|
| 5,115,250 | A | 5/1992 | Harmon et al. | |
| 5,432,539 | A * | 7/1995 | Anderson | 347/33 |
| 5,870,116 | A | 2/1999 | Kyoshima | |
| 5,946,009 | A | 8/1999 | Youn | |
| 6,183,060 | B1 | 2/2001 | Tokuda | |
| 6,189,998 | B1 | 2/2001 | Yanagi et al. | |
| 6,367,911 | B1 | 4/2002 | Windel et al. | |
| 6,390,577 | B1 | 5/2002 | Fajour | |
| 6,530,643 | B1 | 3/2003 | Askren et al. | |
| 7,182,428 | B2 | 2/2007 | Le Gallo | |
| 2002/0126176 | A1 | 9/2002 | Nishi et al. | |
| 2007/0002094 | A1 | 1/2007 | Kim et al. | |
| 2007/0097173 | A1 | 5/2007 | Hubler et al. | |

FOREIGN PATENT DOCUMENTS

| | | |
|---|---|---|
| JP | 11-300980 | 1/1999 |

* cited by examiner

*Primary Examiner* — Jerry Rahll
(74) *Attorney, Agent, or Firm* — Schiff Hardin LLP

(57) ABSTRACT

In a device for cleaning an inkjet print head (in particular the surface with nozzle exit openings) for a franking and/or addressing machine in which the print substrates are directed along a stationary but pivotably arranged inkjet print head, the entire nozzle exit surface is cleaned in a short time and a contamination of the transport region is avoided, with a small apparatus expenditure, by a wiping device formed by a driven wiping roller that is transversally, non-positively directed along the nozzle exit surface in a cleaning operation, and that continuously, non-positively rests on an associated cleaning element. The nozzle surface is repeatedly wiped off and the wiping roller is simultaneously cleaned in a single pass. An actuator of the wiping roller can be selectively coupled with an actuator for a cleaning and sealing device that operates the cleaning element, or can be autonomous. The cleaning element can be a stripper for the wiping roller that rests parallel to and positively on the wiping roller.

14 Claims, 7 Drawing Sheets

Fig. 3
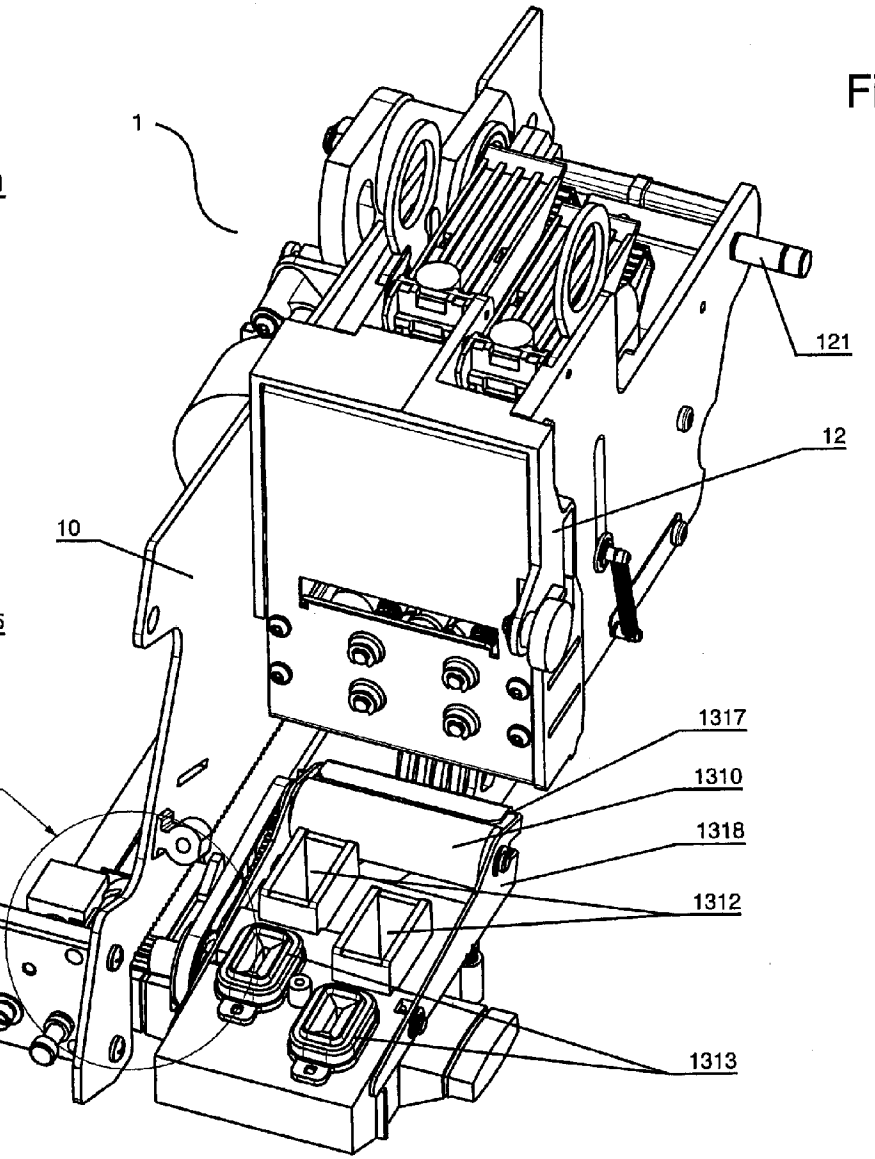
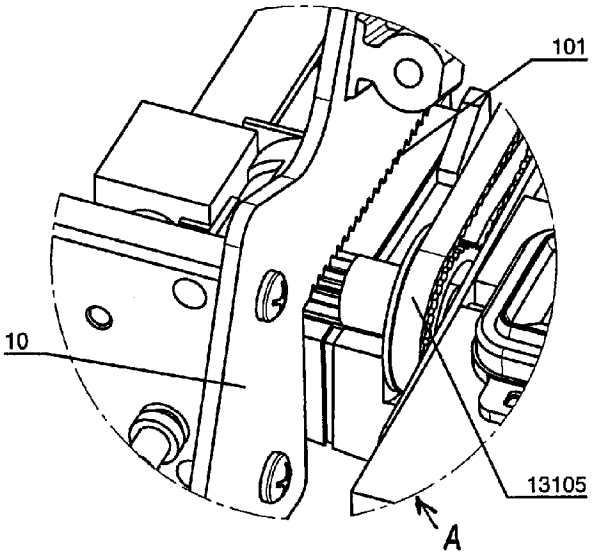
Fig. 3A

DEVICE FOR KEEPING AN INKJET PRINT HEAD CLEAN

BACKGROUND OF THE INVENTION

1. Field of the Invention

The invention concerns a device for keeping an inkjet print head for franking and/or addressing machines clean, in particular the surface with the nozzle exit openings therein.

2. Description of the Prior Art

It has proven valuable to utilize the advantages of inkjet printing in the field of machine franking and/or addressing. The printing ensues without contact by means of an inkjet print head (see for example DE 44 24 771 C1 and EP 0 696 509 B1). However, the inkjet printing technique has the disadvantage that, in addition to the free spraying of the nozzles, the surface with the nozzle exit openings—called a nozzle surface for short in the following—must be regularly cleaned in order to prevent a choking of the nozzles and to ensure a secure sealing by the sealing cap.

Ink mist and paper dust deposits increasingly occur during the printing operation, and ink deposits increasingly occur during priming. The quick-drying ink in connection with the paper dust leads to contaminations at the typical operating temperature of 40° C. of the inkjet print heads, which contaminations are difficult to remove. Repeated wiping is necessary for this purpose. During this time, the machine is not available for the normal operation. Such downtimes reduce the letter throughput.

A device for cleaning an inkjet print head in a franking and/or addressing machine is known (see EP 1 782 954 A1) in which the inkjet print head is arranged stationary but pivotable in a print window or guide plate for the print substrate. The inkjet print head is selectively pivotable into a printing position or into various cleaning areas as well into a sealing position by means of associated displacement means (see also FIG. 1 in the following).

A cleaning and sealing device 13 (CSD in the following) is likewise arranged behind the guide plate (not shown) but below the inkjet print head 110. The CSD 13 is moved towards the inkjet print head 110 and away from this again by means of associated displacement means. The CSD 13 has a receptacle 131 with multiple wiper lips 1311 situated one after another, a spray duct 1312 and a sealing cap 1313 that are arranged in the cited order behind the guide plate.

In the cleaning region adjacent to the sealing position, the inkjet print head 110 is pivoted out of the printing position so far that the nozzle surface 111 lies in the engagement region of the wiper ellipsoid 1311 that slide along on the nozzle surface 111 in the cleaning operation. In order to achieve a thorough cleaning, the nozzle surface 111 must be repeatedly wiped in spite of multiple wiper lips 1311. This involves long downtimes. In the sealing position, the nozzle surface 111 is arranged orthogonal to the wiper lips 1311.

A carrier 1317 with strippers 13171 that is arranged stationary in the engagement region of the wiper lips 1317, above said wiper lips 1317, is in turn provided to clean the wiper lips 1317. After the cleaning operation, the wiper lips 1317 are directed towards the strippers 13171. The wiper residues can fall into an ink sump located under the CSD 13.

Furthermore, a device to clean inkjet nozzles of an inkjet print head of a franking machine is known (see EP 1 504 905 B1) that has a means to abrade the nozzle surface. The means is an impeller that slides with its blades along the nozzle surface of the inkjet print head arranged stationary in a printing window after at least one mail piece has passed the inkjet print head.

Contacting the inkjet print head and rotation movement of the impeller are triggered by the mail piece. In this way the impeller can be pivoted between an abrading position in which it is arranged in the transport path of the mail pieces in the franking machine and a rest position in which it is drawn back from the transport path. The impeller is consequently always arranged more or less far into a region in front of the inkjet print head. The cleaning device moreover comprises a scraper [ductor] to clean the blades of the impeller.

The impeller is mounted on pivoting support arm which can move between the scraper position and the rest position. The movement of the pivot support arm is controlled dependent on the number of mail pieces counted by a position sensor. The position sensor is mounted in the transport path of the maul pieces and controls an electromagnet that is coupled with the pivot arm. The impeller has a torque motor.

However, the disadvantages outweigh the advantages of short paths and downtimes for the cleaning process. The transport region is thus contaminated by the rotating impeller in the cleaning process. Since the impeller is only centrally placed in the region of the nozzle series due to the pivot movement onto the nozzle surface, the edge regions are either not contacted at all or, respectively, are contacted only with slight force at correspondingly larger circumference. This results in an incomplete cleaning of the nozzle surface. The technical expenditure is considerable. The expenditure for the cleaning doubles given use of two inkjet print heads for the purpose of printing longer columns.

SUMMARY OF THE INVENTION

An object of the invention is to expand the functional security of a franking machine to extend the lifespan of the printing device, and to achieve an optimally high letter throughput.

A more specific object of the invention is to provide a device for cleaning the nozzle exit surface of an inkjet print head in a franking and/or addressing machine with which the entire nozzle exit surface is cleaned in a brief time, contamination of the transport region is avoided, and the technical expenditure is small.

The above objects are achieved in accordance with the present invention by a device for cleaning an ink jet print head having a nozzle exit surface with nozzle openings therein, wherein the ink jet print head is arranged in a printing device so as to be stationary but pivotable in a print window of a guide plate for items to be printed that are directed along the ink jet print head, and wherein the printing device has a cleaning and sealing device located behind the guide plate and below the ink jet print head, that is movable toward and away from the ink jet print head by a displacement element and that has a receptacle with a wiping surface, a spray duct and a sealing cap in sequence behind the guide plate, and wherein the wiping device is an actuated, elastic wiping roller that is transversely, freely movably directed across the nozzle exit surface in a cleaning operation and that continuously, non-fixedly rests on an associated component of the cleaning and sealing device.

BRIEF DESCRIPTION OF THE DRAWINGS

FIG. 3 shows the printing system with CSD according to FIG. 2 from above, rear right, with a detail of the actuator for the CSD.

FIG. 3A shows detail A from FIG. 3.

DESCRIPTION OF THE PREFERRED EMBODIMENTS

The representation is schematically executed in part for simplification and for an easier comprehension.

Figure 1:
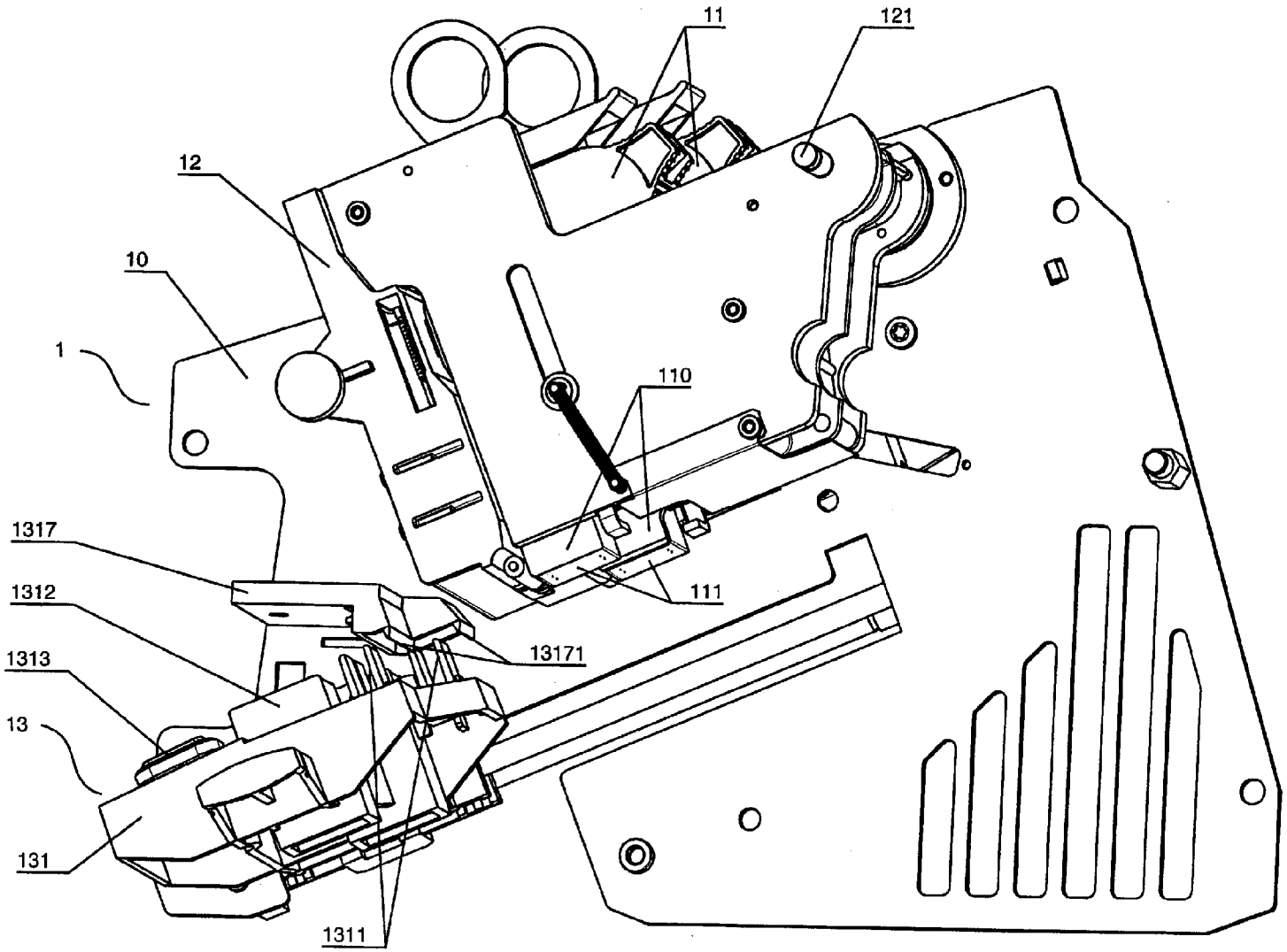
FIG. 1 shows a printing system with cleaning and sealing device (CSD) in the cleaning position according to EP 1 782 954 A1, in a perspective view from the front, lower left.
Figure 2:
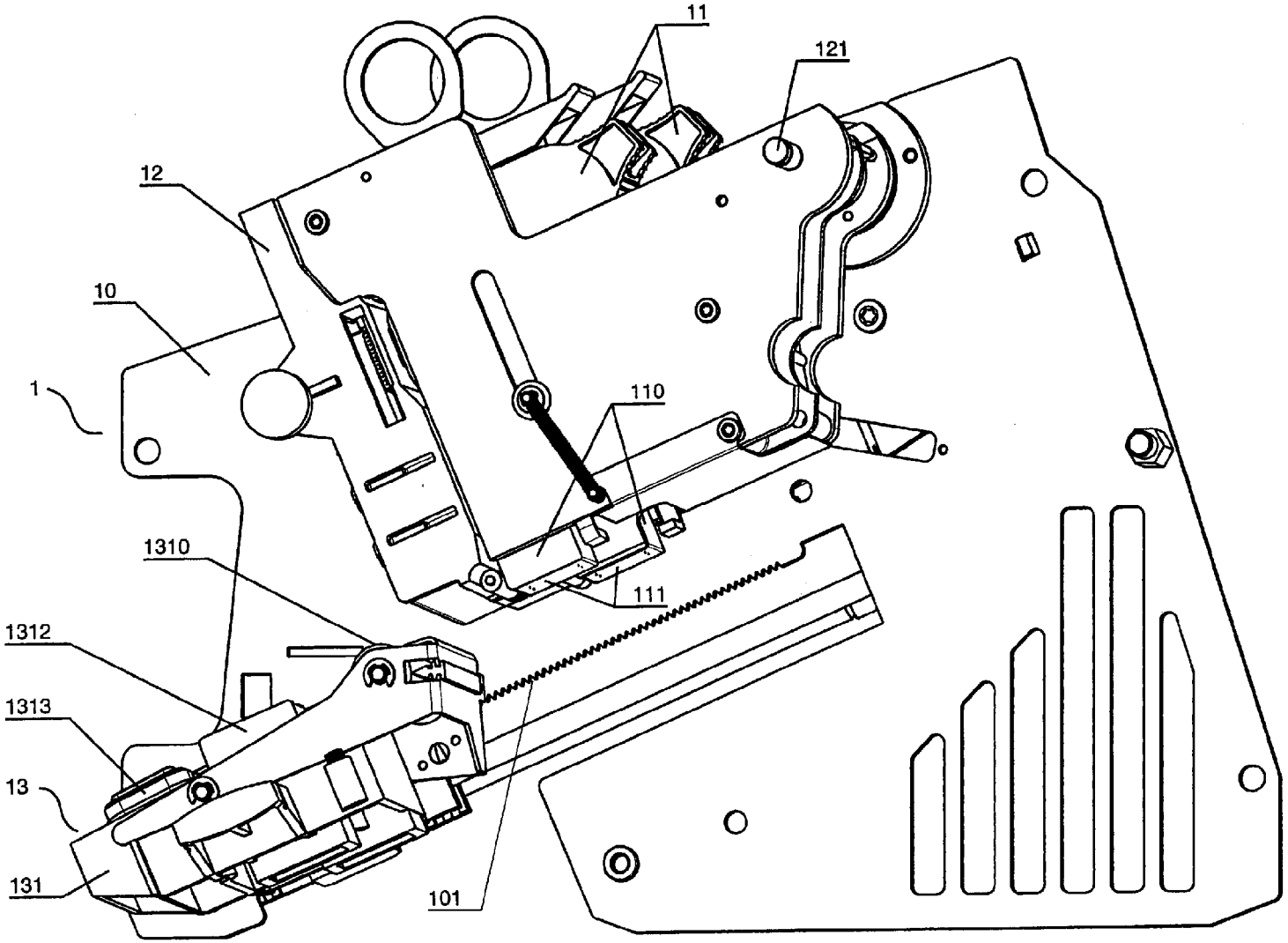
FIG. 2 shows a printing system with cleaning and sealing device in the cleaning position according to the invention, in a perspective view from the front, lower left.

For the printing system 1 according to FIG. 2, correlation exists with the printing system 1 described above with regard to FIG. 1 except for the features regarding the CSD 13, including the actuator for the wiping roller 1310.

The printing system 1 has a frame 10; two printing modules 11, a receptacle 12 for both of the aforementioned printing modules, as well as the associated CSD 13 (see also FIG. 3 and FIG. 3A).

Each printing module 11 has an inkjet print head (IPH in the following) 110 in addition to ink supply and control board (not labeled). The respective nozzle surface 111 of the IPH 110 of the printing modules 11 are arranged offset, parallel to one another. The required print column length is achieved in this manner. The printing modules 11 are correspondingly arranged offset in the receptacle 12.

The receptacle 12 is supported such that it can pivot on an axle 121 that is fastened in the frame 10. The displacement of the receptacle 12 ensues by means of an adjustment motor via a worm gear pair (not labeled). A toothed profile 101 is provided on the frame 10 for the actuation of the CSD 13.

Figure 4:
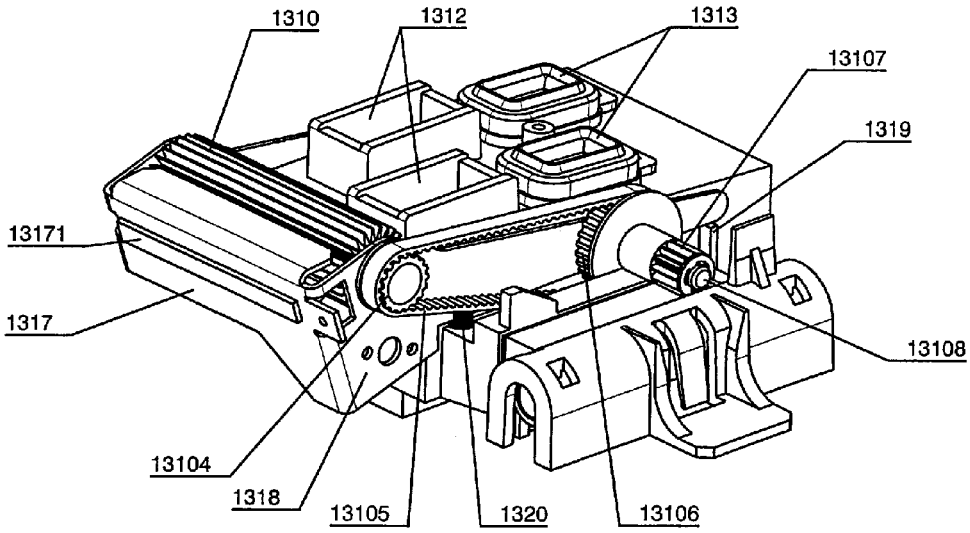
FIG. 4 shows the CSD according to FIG. 3, with wiping roller and associated actuator, from the front, above right.
Figure 5:
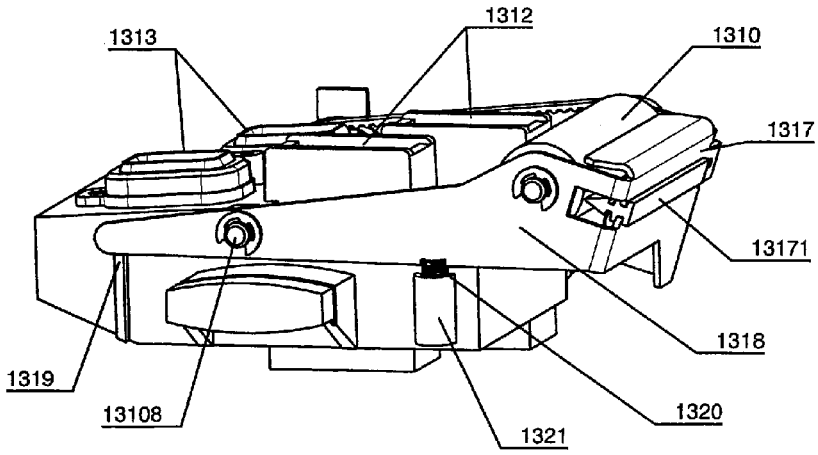
FIG. 5 shows the CSD according to FIG. 4, from the rear, above left.
Figure 7:
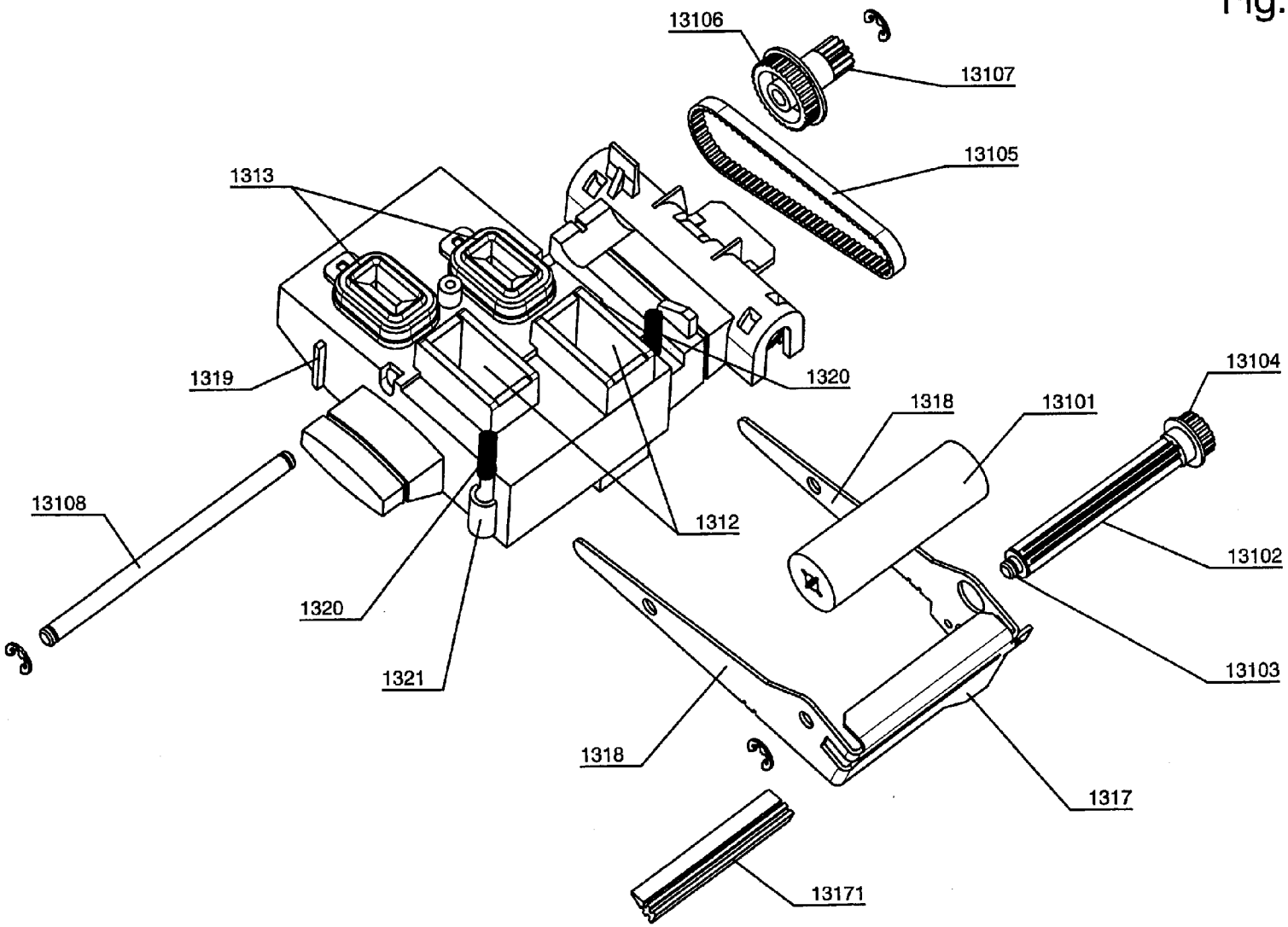
FIG. 7 is an exploded view of the CSD according to FIG. 4.

The CSD 13 has a receptacle 131 with the aforementioned wiping roller 1310, two spray ducts 1213 and two sealing caps 1313 that are arranged in the cited order behind the guide plate (not shown; see also FIGS. 4, 5 and 7). As is apparent, both nozzle surfaces 111 are cleaned with one and the same wiping roller 1310.

A combination of synchronous belt 13105, gearwheel 13106, pinion 13107 and common drive axle 13108 serves as an displacement means for the receptacle 131 (and therefore simultaneously for the CSD 13), wherein the pinion engages in the toothed profile 101 on the frame 10. The drive axle 13108 is connected with a corresponding motor in a manner that is not shown. The winding roller 1310 is connected via the synchronous belt 13105 with the actuator for the receptacle 131 and is automatically rotated with its displacement.

For the mounting of the wiping roller 1310, a retaining clip 1318 is flexibly supported on the drive axle 13108 at the receptacle 131, which drive axle 13108 is moreover fashioned as a carrier 1317 for the stripper 13171 fir the wiping roller 1310. The stripper 13171 with its cutter-shaped edge lies parallel to and non-positively on the wiping roller 1310. In this way the wiping roller 1310 is automatically cleaned without a position change simultaneously with start-up.

For the free ends of the retaining clip 1318, web-shaped stoppers 1319 are provided at the receptacle 131, for which compression springs 1320 on molded pins 1321 are provided as counterpart on the other side to elastically support the retaining clip 1318 (see in particular FIGS. 5 and 7). A uniform, non-positive placement of the wiping roller 1310 on the nozzle surface 11 in the wiping operation is ensured in this way. A uniform cleaning of the entire nozzle surface 11 is therefore ensured. The wiping roller 1310 has an elastic jacket 13101 and a rigid core 13102 on an axle 13103. The outer contour of the core 13102 and the inner contour of the jacket 13101 are positively adapted to one another. The core 13102 can also be designed so that the axle 13103 is omitted.

The stripper 13171 is inserted into a slot in the carrier 1317. An exchange for the purpose of replacement or cleaning is therefore easily possible.

Figure 6:
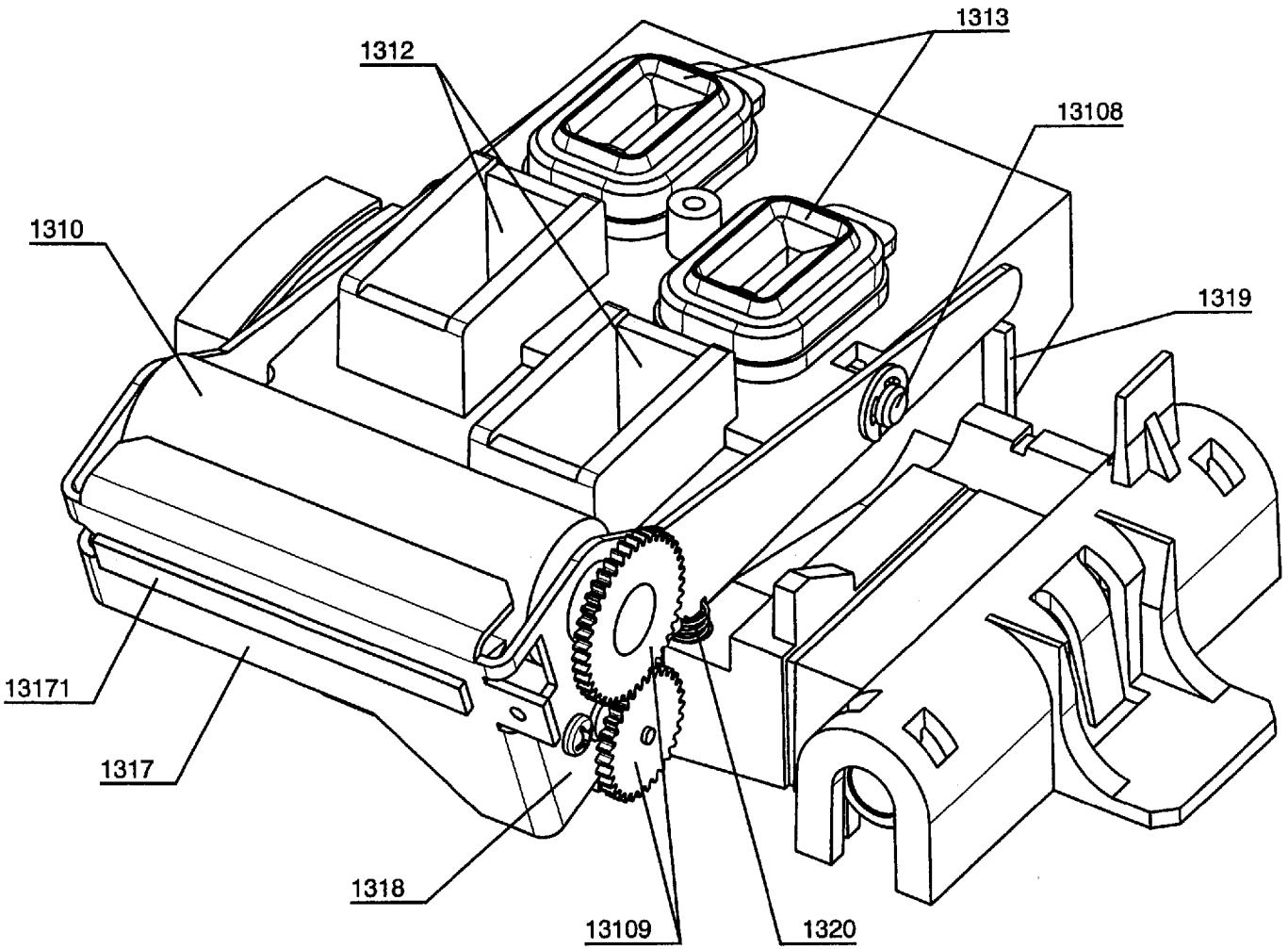
FIG. 6 shows an CSD with autonomous actuator for the wiping roller, in a perspective view from the front, above right.

An embodiment of a wiping roller 1310 with an autonomous actuator 13109 is shown in FIG. 6. The autonomous actuator is realized in the form of a gearwheel pair with face serration and a motor.

Preferred embodiments of the jacket 13101 of the wiping roller 1310 are shown in FIGS. 8*a* through 8*d*.

Figure 8D:
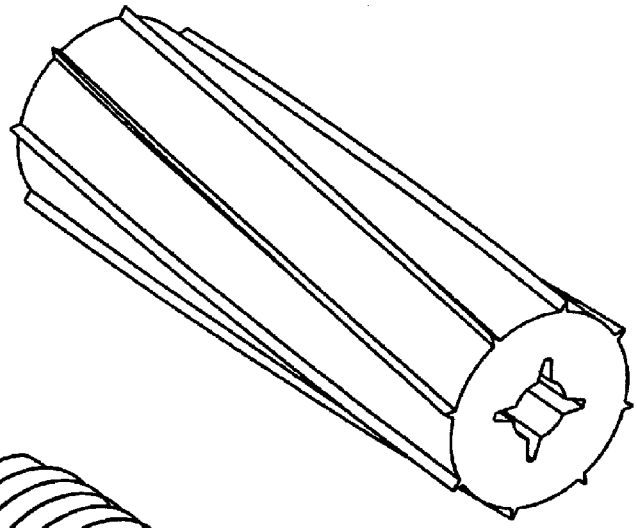
FIGS. 8A. 8B, 8C and 8D respectively show variants of the wiping roller.
Figure 8C:
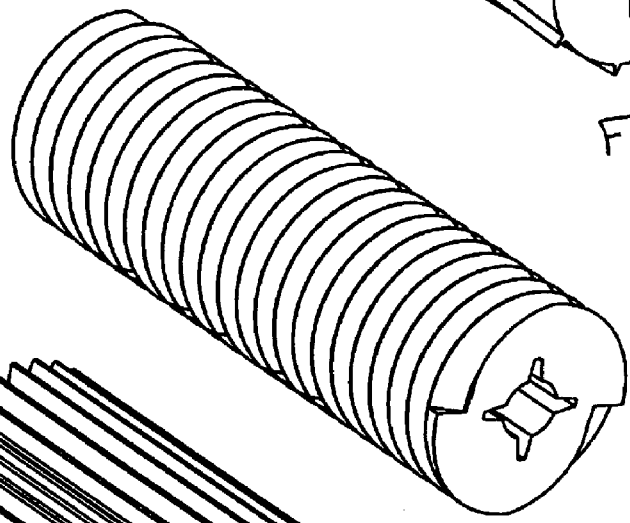
Figure 8B:
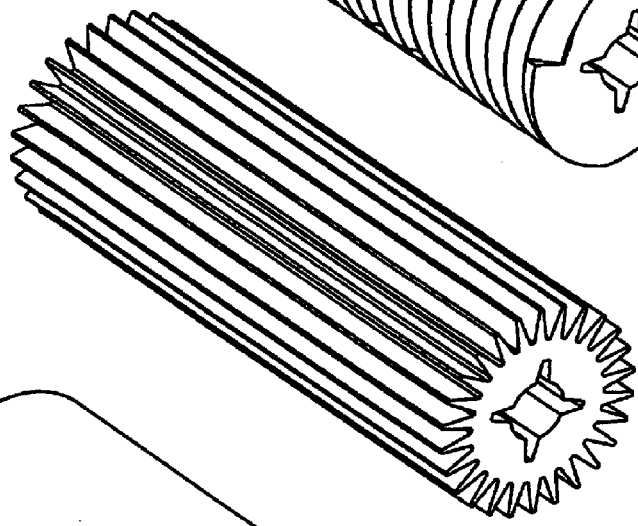
Figure 8A:
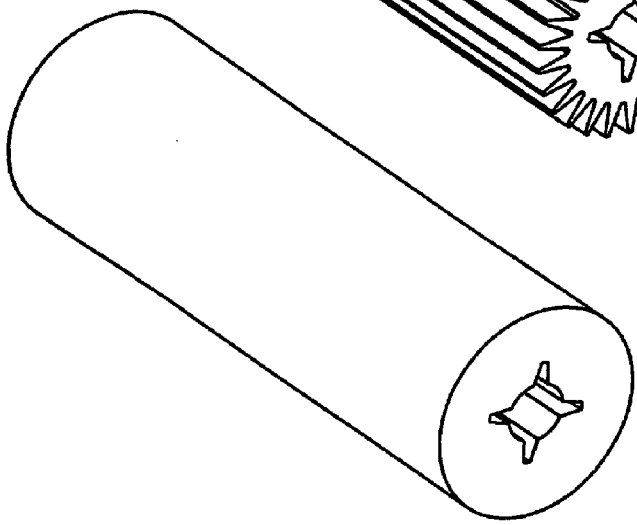

According to FIG. 8A, the jacket 13101 is executed as a hollow cylinder made from an elastic, absorbent material such as a plastic sponge.

According to FIG. 8B, the jacket 13101 is executed as a hollow cylinder made from a rubber elastic material with blades (lamellae) on the outer periphery, which blades run parallel to the roller axis. It is also possible to arrange the blades helically around the roller axis (see FIG. 8D).

According to FIG. 8C, the jacket 13101 is executed as a hollow cylinder made from a rubber elastic material with a helically revolving, semi-circular bead on the outer circumference. In this variant, the ink and dust particles are removed from the nozzle surface 11 and laterally shifted away, similar to the principle of an Archimedean screw.

Although modifications and changes may be suggested by those skilled in the art, it is the intention of the inventors to embody within the patent warranted hereon all changes and modifications as reasonably and properly come within the scope of their contribution to the art.

We claim as our invention:

1. In a device for cleaning an ink jet print head having a nozzle exit surface with nozzle openings therein of a printing device in which the ink jet print head is mounted stationary but pivotable in a print window of a guide plate for items to be printed that are directed by the guide plate along the ink jet print head, and having a cleaning and sealing device behind the guide plate and below the ink jet print head that is movable toward and away from the ink jet print head by a displacement device and that contains a receptacle with a wiping device, a spray duct and a sealing cap in sequence behind the guide plate, the improvement comprising:

said wiping device being formed as an actuated, elastic wiping roller that is transversely freely rotatably directed along the nozzle exit surface in a cleaning operation implemented by said cleaning and sealing device, and that continuously rests without constraint on a cleaning element of the cleaning and sealing device.

2. The improvement of claim 1 wherein said wiping roller comprises a rigid core surrounded an elastic jacket, said rigid core being connected to an axle, said core having an outer surface and said jacket having an inner surface conforming to said outer surface of said core, with said jacket being held on said core by a friction fit.

3. The improvement of claim 2 wherein said elastic jacket is a hollow cylinder comprised of a resilient, absorbent material.

4. The improvement of claim 2 wherein said jacket is a hollow cylinder comprised of a rubber resilient material having a plurality of blades on an outer circumference of said hollow cylinder.

5. The improvement of claim 4 wherein said blades are oriented parallel to a rotational axis of said axle.

6. The improvement of claim 4 wherein said blades proceed helically relative to a rotational axis of said axle.

7. The improvement of claim 2 wherein said jacket is a hollow cylinder comprised of a rubber resilient material having a helically rotating, semi-circular bead on an outer circumference thereof.

8. The improvement of claim 2 comprising a pinion connected to said core that mechanically couples said wiping roller with said displacement device of said cleaning and sealing device.

9. The improvement of claim 2 comprising an autonomously operating actuator connected to said wiping roller.

10. The improvement of claim 9 wherein said actuator comprises a pair of gears driven by a motor, with one of said gears being directly connected to said wiping roller.

11. The improvement of claim 1 comprising a blade-shaped stripper forming said cleaning element, that interacts with said wiping roller to clean said wiping roller.

12. The improvement of claim 11 wherein said receptacle of said cleaning and sealing device comprises a U-shaped elastic retaining clip having a free end supported on a drive axle and having a transverse web that supports said winding roller and said stripper parallel to each other and positively resting on each other.

13. The improvement of claim 12 wherein said stripper is supported by said retaining clip allowing said stripper to be exchanged.

14. The improvement of claim 12 wherein said retaining clip comprises free legs, and wherein said receptacle comprises stops respectively for said free legs and compression springs supporting said free legs at an opposite side of said drive axle, said compression springs being disposed on respective pins attached to said receptacle.

* * * * *